US006544384B2

(12) United States Patent
Henricson et al.

(10) Patent No.: US 6,544,384 B2
(45) Date of Patent: Apr. 8, 2003

(54) PRETREATMENT OF CHIPS BEFORE COOKING

(75) Inventors: Kaj O. Henricson, Kotka (FI); Aki Hannu Vilpponen, Karhula (FI); Hannu Olavi Ramark, Kotka (FI); Auvo Kimmo Kettunen, Karhula (FI); C. Bertil Stromberg, Glens Falls, NY (US)

(73) Assignee: Andritz Inc., Glen Falls, NY (US)

( * ) Notice: Subject to any disclaimer, the term of this patent is extended or adjusted under 35 U.S.C. 154(b) by 0 days.

(21) Appl. No.: 09/975,984

(22) Filed: Oct. 15, 2001

(65) Prior Publication Data

US 2002/0017370 A1 Feb. 14, 2002

Related U.S. Application Data

(62) Division of application No. 09/770,408, filed on Jan. 29, 2001, now Pat. No. 6,506,283, which is a division of application No. 08/460,723, filed on Jun. 2, 1995, now Pat. No. 6,248,208.

(51) Int. Cl.[7] ..... D21C 7/12; D21C 3/26

(52) U.S. Cl. ..... 162/17; 162/19; 162/37; 162/38; 162/39; 162/43

(58) Field of Search ..... 162/17, 19, 37, 162/38, 39, 41, 42, 43

(56) References Cited

U.S. PATENT DOCUMENTS

| | | | |
|---|---|---|---|
| 3,303,088 | A | 2/1967 | Gessner |
| 3,664,918 | A | 5/1972 | Clayton et al. |
| 3,802,956 | A | 4/1974 | Backlund |

(List continued on next page.)

FOREIGN PATENT DOCUMENTS

| | | |
|---|---|---|
| EP | 0 477 059 A2 | 3/1991 |
| WO | WO 91/05103 | 4/1991 |
| WO | WO 9518261 | 7/1995 |

OTHER PUBLICATIONS

Backman et al, "Impregnation–Depolymeri-zation–Extraction Pulping", *Paper and Timber*, vol. 76, Nov. 10, 1994.

Lonnberg et al, "Impregnation–Depolymerization–Extraction (IDE) Pulping of Wood and Nonwood Raw Materials", a paper presented at PTS–TUD Symposium, Paper Chemical and Mechanical Pulp Technology, May 2–5, 1995.

*Primary Examiner*—Dean T. Nguyen
(74) *Attorney, Agent, or Firm*—Nixon & Vanderhye P.C.

(57) ABSTRACT

The strength properties of chemical cellulose pulp (particularly kraft pulp) are improved by substituting a cold impregnation soak for conventional impregnation procedures. After steaming, wood chips are soaked in an alkaline liquid at a temperature of about 80–110° C. (preferably 80–100° C., or 90–105° C.) for between one-half-72 hours (typically about 2–4 hours) at a pressure of about 0–15 bar (preferably about 1–5 bar), to dissolve at least about 8% of the wood (preferably about 10–20%) and at least about 15% of the lignin. The alkaline liquid used preferably contains sulfide (e.g. black liquor, green liquor, white liquor, or mixtures thereof), but almost any alkaline liquid having an alkali concentration of about 1.0 mole of NaOH/liter or less (typically about 0.75 m/l or less) is suitable. The wood chips are then raised to a cooking temperature of about 145–180° C. and cooked to produce the cellulose chemical pulp. There may be an intermediate step, between soaking and raising the cooking temperature, of heating the wood chips to a temperature of about 110–150° C. (preferably about 120–140° C.) for about 10–90 minutes (preferably about 10–30 minutes). Alternatively or additionally the majority of the dissolved lignin (and/or other solids) may be removed before raising the wood chips to cooking temperature. The system for treating the wood chips need only include a low pressure soaking vessel (with an associated pump or other transfer device) in addition to conventional equipment.

3 Claims, 5 Drawing Sheets

U.S. PATENT DOCUMENTS 5,053,108 A 10/1991 Richter
5,080,755 A 1/1992 Backlund
5,192,396 A 3/1993 Backlund
5,213,662 A 5/1993 Henricson
5,236,553 A 8/1993 Richter
5,522,958 A 6/1996 Li
5,660,686 A * 8/1997 Henricson et al. ..... 162/41

* cited by examiner

PRETREATMENT OF CHIPS BEFORE COOKING

This application is a division of application Ser. No. 09/770,408, filed Jan. 29, 2001, now U.S. Pat. No. 6,506, 283, which is in turn a division of application Ser. No. 08/460,723, filed Jun. 2, 1995, now U.S. Pat. No. 6,248,208, issued Jun. 19, 2001, the entire content of which is hereby incorporated by reference in this application.

BACKGROUND AND SUMMARY OF THE INVENTION

In the preparation of kraft cellulose pulp, particularly by continuous cooking techniques, wood chips (or like comminuted cellulosic fibrous material) are normally presteamed to remove the air from the chips and to preheat them to a temperature of about 100–120° C. According to Rydholm "Pulp Processes", a higher temperature leads to both carbohydrate hydrolysis and liquor condensation. After this the chips typically pass into a chip chute associated with a high pressure feeder, in which they are entrained in cooking liquor at a temperature of about 115–130° C., and while being transferred and either at the top of the digester or in a separate impregnation vessel, are impregnated with the cooking liquor at this temperature, typically for about 15–30 minutes. Afterwards the slurry is heated to a temperature of about 150–170° C. for actual cooking, which takes place in the digester. There are about 400 continuous digesters operating worldwide in this manner, which has long been accepted as the appropriate way of preparing chips for cooking, and then effecting continuous cooking.

According to the present invention it has been found that this conventional, widely accepted, method of handling chips prior to kraft cooking may in fact have an adverse effect on the strength of the pulp produced especially when producing pulp with lower than normal Kappa No. The conventional wisdom in the art has failed to take cognizance of the fact that when the chips are at the temperature that they are during conventional impregnation that the acid substances that are formed, including by hydrolysis reactions and during delignification, often provide a sufficient build up of acid—prior to neutralization with the alkali liquid in which the chips are impregnated—that the acid can attack the cellulose in the chips, and/or cause lignin condensation, both of which are adverse to the subsequent pulping operations, and at least the acid attacking the cellulose having an adverse affect on pulp strength. According to the present invention it has been recognized that the diffusion of the alkali into the wood chips is not quick enough to neutralize the acidic substances, and that therefore a different approach must be taken if maximum ultimate pulp strength is to be obtained from a given source of raw cellulose material.

According to the present invention, instead of heating the chips to the temperature range of 110–130° C., in which the hydrolysis, delignification, and other chemical reactions start (and produce acid), the chips are instead "cold" impregnated. That is they are subjected to impregnation in such a way that any chemical reactions producing acid are slow enough so that diffusion of the alkali from the impregnating liquor is sufficiently rapid so as to neutralize the acid formed before it can attack the cellulose and/or cause lignin condensation. If no chemical reactions take place, there is sufficient time for the alkali to diffuse into the cells so that when acid is produced alkali is immediately available to neutralize it. It has been surprisingly found that according to the present invention that the alkali concentration can be relatively low while these results are satisfactorily achieved, and that ultimately a pulp with improved strength compared to pulp produced by conventional impregnation techniques is provided.

According to one aspect of the present invention a method of impregnating comminuted cellulosic fibrous material (such as softwood chips, but also including a wide variety of other cellulose materials such as hardwood, bagasse, and agricultural materials) comprises the steps sequentially continuously: (a) Removing air from the comminuted cellulosic fibrous material and preheating the material to a temperature above ambient. (b) Soaking the material in an alkaline liquid (preferably containing sulfide) at a temperature such that if acid-forming chemical reactions take place at all, the reactions take place slowly enough so that the acid produced will be neutralized by the alkaline liquid before the acid can damage the cellulosic material or cause lignin condensation; and wherein the alkali concentration of the liquid is sufficient to neutralize any acid produced; and for a time period sufficient to substantially completely impregnate the cellulose material with alkali. And, (c) raising the alkali-impregnated cellulosic material to cooking temperature to effect continuous cooking thereof to produce cellulose pulp. The cooking is preferably to a lower than normal Kappa No., i.e. for kraft cooking lower than Kappa No. 25, even lower than Kappa No. 20.

In the practice of the method as described above, step (a) is typically practiced by presteaming in a conventional manner, except that the maximum temperature at which the chips are steamed is about 110° C. Preferably presteaming to preheat the chips and remove the air takes place at about 80–110° C. (more desirably 90–105° C., and perhaps most desirably at about 90–100° C.) for a time period of about 5–60 minutes (typically about 10–30 minutes). It is advantageous (but not necessary) to have alkali present during steaming. This way condensates formed during steaming become alkaline. Alkali can be added to the chips before or during steaming in the form of ash or powder, white liquor, black liquor, or the like. Step (c) is preferably practiced in a continuous digester, with a cooking temperature of about 145–180° C.

Step (b), which is the essence of the present invention, for most cellulosic fibrous materials is practiced at a temperature of about 80–110° C., more desirably about 90–105° C., or 80–100° C. Treatment time is typically at least half an hour, and the treatment time may be substantially indefinite as long as the pulp mill can afford this aspect of the processing to proceed very slowly, and as long as there is no adverse affect on the cellulosic material (which there typically would not be in a relatively mildly alkaline liquid). As a practical matter the time period for treatment would rarely be over 72 hours, and most desirably is about 1–4 hours with about 2–3 hours being optimum. The soaking need not be at high pressure; in fact the only reason for utilizing superatmospheric pressure at all would be to compress possible gas bubbles to make it easier for the chips to sink. In conventional impregnation the pressure is about 10–20 bar, whereas according to the present invention step (b) would be practiced at 0–15 bar, preferably 0 to 5 bar or 1–5 bar.

Step (b) typically is practiced so as to dissolve at least about 8% of the wood material (preferably about 10–20%), and also to dissolve at least about 15% of the lignin, typically about 20–40%. Substantially all of, or at least a majority of, the dissolved lignin (and other organic solids, like hemi-cellulose) may be removed before step (c), which has advantages in the ultimate entire treatment sequence.

Between steps (b) and (c) there may be a further step of heating the cellulosic material to a temperature of about 110–150° C. for about 10–90 minutes (preferably 120–140° C. for about 10–30 minutes).

During the practice of step (b) while higher alkali concentrations can be utilized, it is not necessary to use an alkali concentration of over about 1.0 mole of NaOH per liter (or the equivalent of other alkalis), and in fact an alkali concentration of about 0.75 mole of NaOH per liter or less is very effective.

According to another aspect of the present invention a method of impregnating wood chips is provided comprising the steps of sequentially: (a) Steaming the chips to remove air from them and to heat them to a temperature of about 80–100° C. (b) Soaking the chips in an alkaline liquid (preferably also including sulfide) for about 1–72 hours at a temperature of about 80–110° C. (preferably about 80–100° C.) to impregnate the chips with the alkali and dissolve at least about 8% of the wood. And, (c) raising the wood chips to cooking temperature and effecting continuous cooking thereof to produce cellulose pulp.

The invention also relates to a novel kraft pulp, the pulp according to the present invention having improved strength compared to kraft pulps otherwise exactly produced only using conventional impregnation techniques as opposed to the cold soaking technique of the invention. That is according to another aspect of the present invention kraft paper pulp having improved strength is provided produced by the steps of sequentially continuously: (a) Removing air from the comminuted cellulosic fibrous material and preheating the material to a temperature above ambient. (b) Soaking the material in an alkaline liquid (preferably also containing sulfide) at a temperature such that if acid-forming chemical reactions take place at all, the reactions take place slowly enough so that the acid produced will be neutralized by the alkaline liquid before the acid can damage the cellulosic material or cause lignin condensation; and wherein the alkali concentration of the liquid is sufficient to neutralize any acid produced; and for a time period sufficient to substantially completely impregnate the cellulose material with alkali. And, (c) raising the alkali-impregnated cellulosic material to cooking temperature and effecting continuous kraft cooking of the cellulose material to produce chemical pulp having enhanced strength compared to otherwise identically treated material only impregnated in a different manner than impregnation according to step (b). Preferably step (c) is practiced at about 150–180° C. to produce kraft pulp in a continuous digester.

The invention also relates to a system for treating cellulosic fibrous material to produce chemical pulp. The system comprises the following components: Means for removing air from the comminuted cellulosic fibrous material and preheating the material to a temperature above ambient. A first vessel for soaking comminuted cellulosic material from the means for removing air therefrom, and capable of withstanding only a pressure of about 5 bar or less, and an alkaline liquid at a temperature of less than about 110° C. A continuous digester for cooking the cellulosic fibrous material from the first vessel. And, means for transferring the cellulosic material from the first vessel to the digester. The digester is preferably a continuous digester and the transferring means also pressurizes the material during transfer (e.g. may comprise a conventional high pressure feeder). At least one impregnation vessel may be provided between the first vessel and the digester, particularly in retrofit operations, or cold soaking may be done at the top (e.g. impregnation zone) of a single vessel hydraulic digester. Also the system may further comprise means for removing a first liquid from the first vessel, the first liquid containing dissolved lignin/solids, and replacing the first liquid in the first vessel with a second liquid (such as wash or bleach plant filtrates) having a lower content of dissolved lignin/solids than the first liquid. Utilizing the teachings of the invention it may even be possible to eliminate the conventional high pressure feeder in continuous kraft systems. For example, the air removing means may comprise a chip bin with steaming, and the chip bin and first vessel are above the transferring means, and the transferring means is above ground level and consists essentially of a pump [that is being devoid of a high pressure feeder].

It is the primary object of the present invention to simply yet effectively increase the strength of chemical pulp, particularly produced by continuous digesting. This and other objects of the invention will become clear from an inspection of the detailed description of the invention and from the appended claims.

DETAILED DESCRIPTION OF THE DRAWINGS

As described above in the summary of the invention, the invention primarily relates to a method of impregnating comminuted cellulosic fibrous material by sequentially removing air from the comminuted cellulosic fibrous material and preheating to a temperature above ambient (typically by steaming at a temperature of about 80–110° C., preferably about 90–105° C. or 90–100° C., for a time period of about 5–60 minutes, preferably about 10–30 minutes), cold soaking the material in alkali to impregnate the material with alkali, and then raising the alkali-impregnated cellulosic material to cooking temperature and ultimately effecting cooking thereof to produce chemical cellulose pulp.

The cold soaking according to the present invention, in which the material is soaked in an alkaline liquid at a temperature such that if any acid-forming chemical reactions (such as hydrolysis) take place at all they take place slowly enough so that any acid produced will be neutralized by the alkaline liquid in which the material is soaked before the acid can damage the cellulosic material or cause lignin damage, as provided. If no chemical reactions take place, there is sufficient time for the alkali to diffuse into the cells so that when acid is produced alkali is immediately available to neutralize it. The alkaline concentration of the impregnating liquid is sufficient to neutralize the acid produced, and soaking takes place for a time period sufficient to substantially completely impregnate the cellulose material with alkali. The example below—and with reference to the graphs of FIGS. 1 through 4—describes a laboratory experiment which demonstrates the effectiveness of the method according to the present invention:

EXAMPLE

Figure 1:
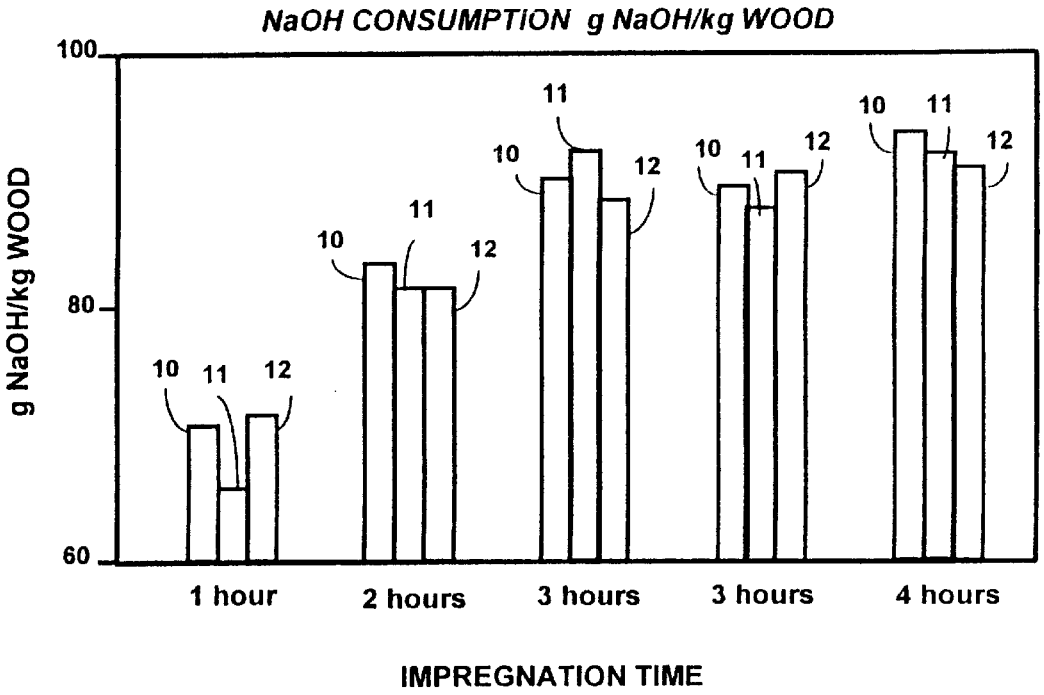
FIG. 1 is a graph of alkali consumption as a function of time in tests showing the viability of the method according to the present invention.

Softwood chips of different thickness (without first steaming them) were put in an alkaline solution with a strength of about 1.0 mole per liter of NaOH and at a temperature of about 100° C., and the consumption of alkali (NaOH) was measured. In this example a liquid without sulfur was used but preferably the alkaline liquid used for soaking/impregnation contains hydrosulfide, sulfide ions, or sodium sulfide. Bars 10 illustrate the results (for varying times) when the chip thickness was about 3 mm, while bars 11 illustrate the results with a chip thickness of about 4–6, and bars 12 with a chip thickness of about 6–8 mm. As seen in FIG. 1, for the particular chip thickness as there, a time period of one hour was not sufficient for complete alkali impregnation, but after about two hours, and certainly after about three hours, the consumption during impregnation and diffusion is stabilized indicating that after this period of time (about two to three hours) heating and cooking may be practiced. [If the chips were pre-steamed it is believed that the time period for effective steaming would lower somewhat.] From the results of the graph of FIG. 1, as well as from other available information, depending upon the particular cellulose material, the exact temperature, the material thickness, and the like, the soaking in alkali according to the invention should be for about 1–72 hours, preferably about 1–4 hours and typically about 2–3 hours.

Figure 2:
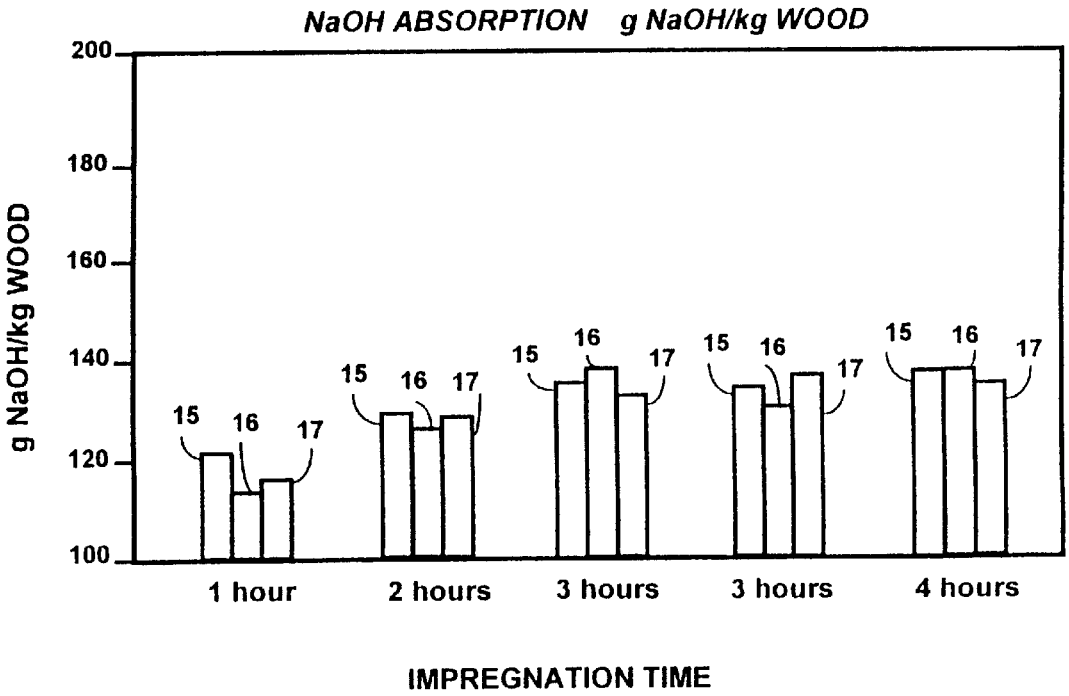
FIG. 2 is a graph similar to that of FIG. 1 but indicating absorbed alkali.

FIG. 2 confirms the results discussed above. FIG. 2 provides a graphical representation similar to that of FIG. 1, with the bars 15 through 17 corresponding to the same wood chip thicknesses as for bars 10 through 12, respectively. FIG. 2 indicates absorbed alkali; i.e. the alkali consumed plus the alkali in the liquid that passes into the chips.

Figure 3:
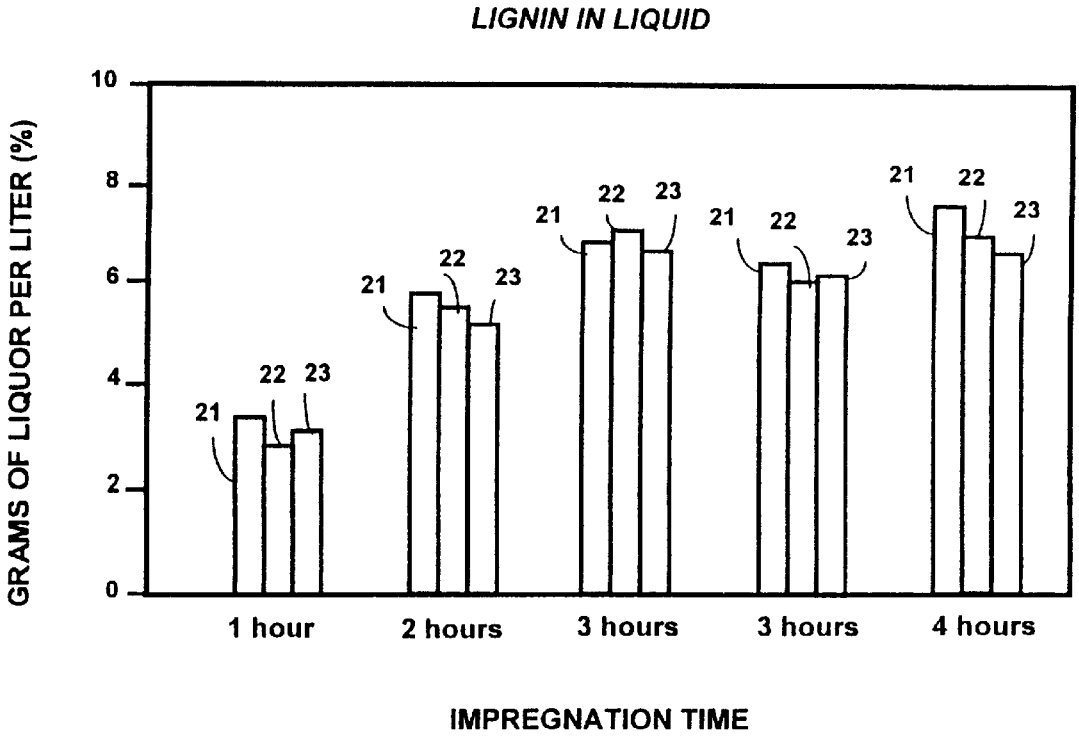
FIG. 3 is a graph indicating the amount of wood material that is dissolved in tests showing the viability of the method according to the present invention.

FIG. 3 indicates that during the cold impregnation according to the present invention a significant amount of wood material is dissolved. Bars 21 through 23 correspond, respectively, to bars 10 through 12 in FIG. 1, being for the same wood chip thicknesses. The graph of FIG. 3, as well as other available information, indicates that during the initial treatment according to the present invention about 15–20% of the wood material is dissolved. The lignin content in the impregnation liquid increases due to dissolved lignin. From the information from FIG. 3, as well as from other available information, it is desired that at least about 8% of the wood be dissolved during impregnation according to the invention, and preferably about 10–20%, and typically at least about 15% of the lignin is dissolved, preferably about 20–40%. This amount of wood and lignin can be dissolved during the "cold" impregnation according to the invention without risk of fiber damage.

Figure 4:
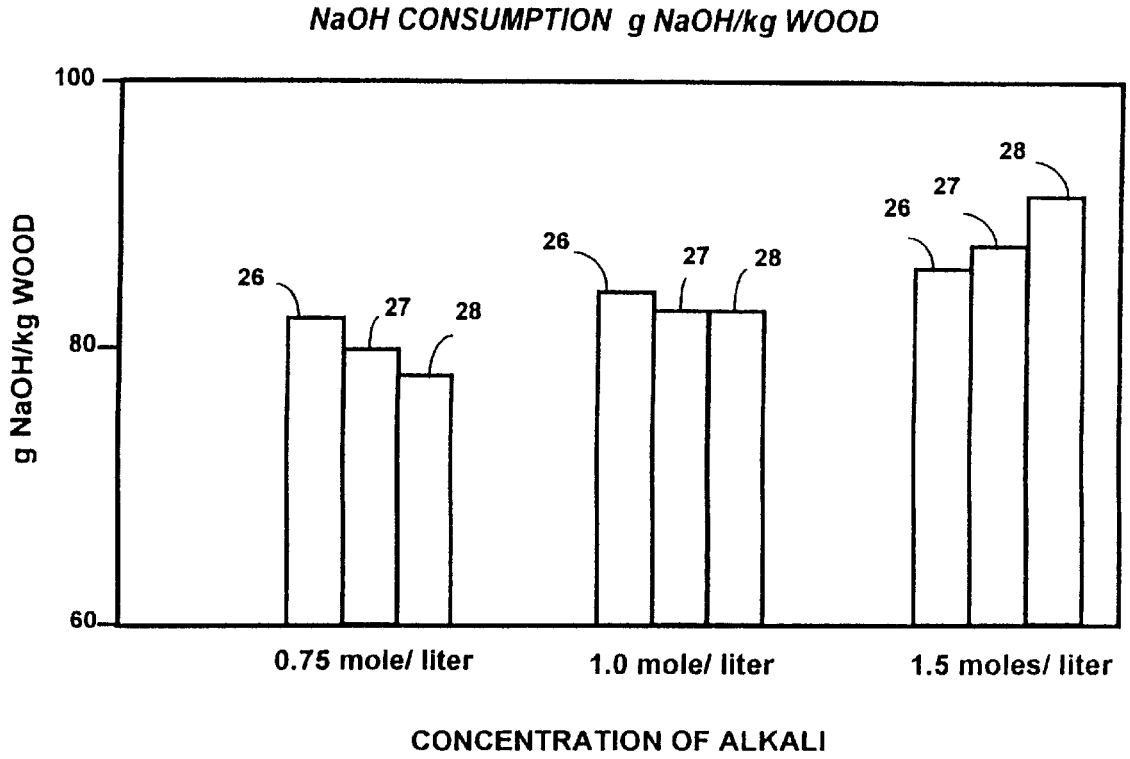
FIG. 4 is a graph showing the affect of alkali concentration during pretreatment at about 100° C. according to the present invention.

The graph of FIG. 4 shows the effect of alkaline concentration during pretreatment at about 100° C. The bars 26–28 correspond to chips of the same thickness as bars 10–12, respectively. The alkali strength for the left bars is about 0.75 mole per liter (all alkali strengths being expressed in NaOH, or equivalent), while for middle bars the alkaline strength is about 1.0 m/l, and for the right bars about 1.5 m/l. The graphical results in FIG. 4 indicate that the alkali strength has no significant affect and therefore it is only necessary to have as much alkali present as needed to neutralize any acidic byproducts from forming acid regions that can damage the fiber properties, being available in the material cells to effectively neutralize. The alkaline needed during actual cooking can thus be added after this pretreatment, and/or during cooking; that is a high level of alkali is not needed during the impregnation. In fact using the information from FIG. 4, as well as other available information, it is desirable according to the present invention that the alkali concentration during the cold impregnation step of the invention be only about 1.0 mole of NaOH per liter or less, in fact preferably about 0.75 mole per liter or less.

Using the data from the example set forth above, as well as other available information, according to the present invention it has been determined that it is desirable to effect impregnation of the chips when they are at a temperature of below about 110° C. A typical temperature in which the cold impregnation according to the invention takes place is about 80–110° C., more desirably about 90–105° C. or about 80–100° C. Preferably the time period is at least half an hour and most desirably about 1–4 hours, optimally about 2–3 hours. The pressure may be 0–15 bar, preferably 0–5 bar, and more preferably 1–5 bar only because a light pressurization compresses possible gas bubbles inside the chips and makes it easier for the chips to sink; however pressurization is not necessary except to reduce the size of the gas bubbles. Thus according to the present invention less costly apparatus and vessels may be utilized since they need not deal with high pressures.

Also according to the present invention it may be desirable to provide additional alkali to start the cooking reaction, and gradually step the chips up to cooking temperatures, by providing a step between the cold impregnation and the cooking-temperature achieving steps in which the cellulosic material is raised to a temperature of about 110–150° C. (preferably 120–140° C.) for about 10–90 minutes (preferably about 10–30 minutes).

The invention is particularly applicable to kraft and soda continuous cooking processes, but may have applicability to other chemical cooking processes.

Also according to one aspect of the present invention it is advantageous to displace out—at least partly—the dissolved lignin and/or other organic solids (e.g. hemi-cellulose) after pretreatment but before cooking in order to minimize the concentration of dissolved material during actual cooking (for the advantageous reasons as described in U.S. Pat. No. 5,489,363, the disclosure of which is hereby incorporated by reference herein). The displacement of the lignin/solids containing liquor of the first concentration of lignin with liquor having a lower lignin/solids concentration can be done with white liquor, diluted white liquor, black liquor (e.g. from lower screen 52 in FIG. 6), bleach plant effluent, pulp washing effluent, or the like. If at least a majority of the dissolved lignin/solids are removed it is very possible according to the present invention that the amount of dissolved lignin/solids during actual cooking will be 30–50% less than in conventional processes, reducing the risk of lignin condensation during cooking.

The actual source of the alkaline liquid for practicing the present invention is not particularly significant; however it desirably contains at least some sulfide. Black liquor, green liquor, white liquor, alkaline bleach plant effluent, or a mixture of these (particularly a mixture of white liquor and black liquor), as well as other readily available alkaline liquids, can be used. These liquids may have additives provided to them, such as polysulfide, anthraquinone, or complex formers (chelants). It is desirable to use a liquid having a high concentration of sodium sulfide [e.g. from screens 51 in FIG. 6]; sulfide containing liquid may be added during soaking, or between soaking and cooking.

Figure 5:
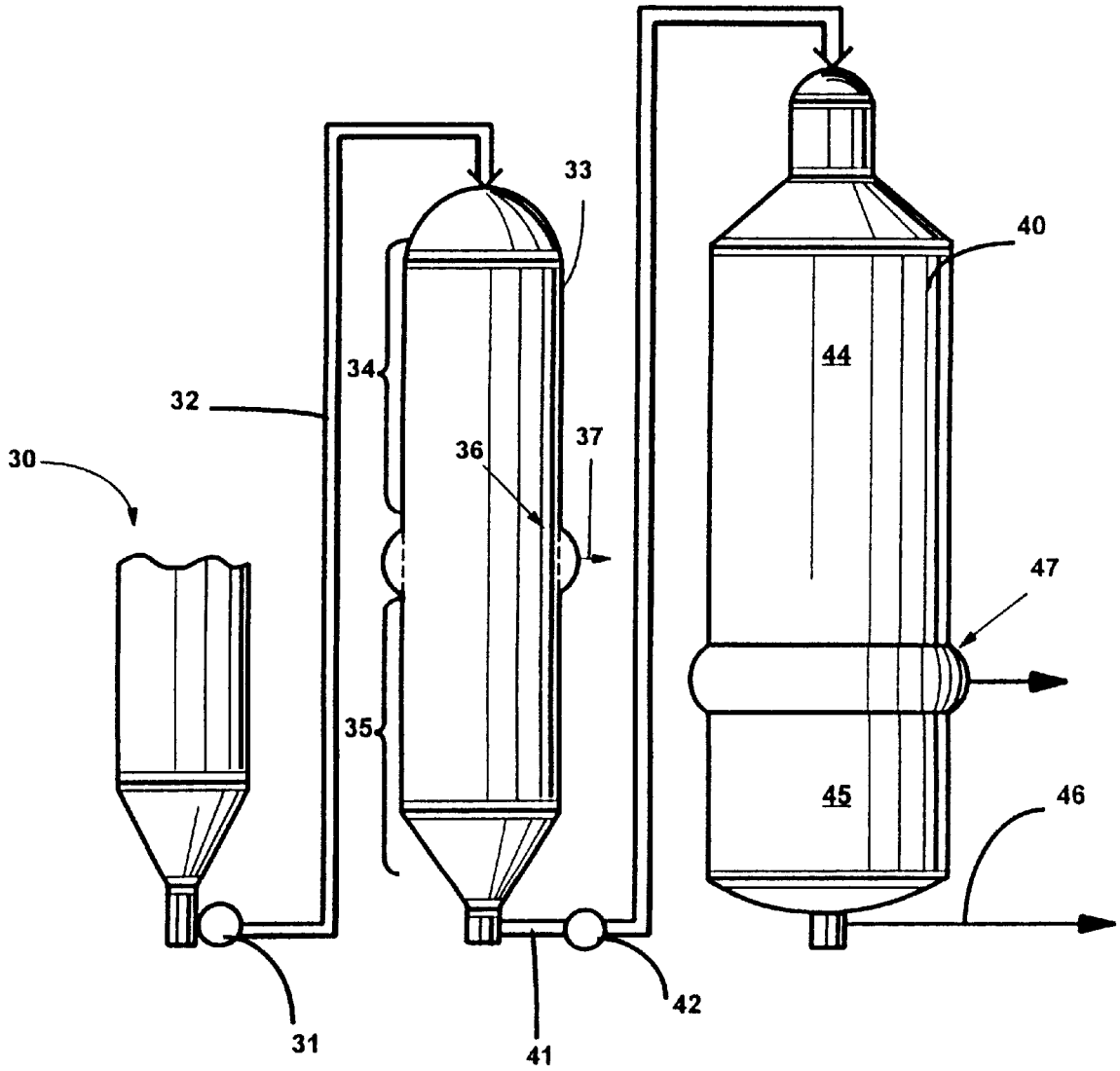
FIG. 5 is a schematic view showing a first exemplary embodiment of various pieces of equipment that may be used in an exemplary system according to the present invention.

FIG. 5 schematically illustrates various pieces of equipment that may be used in an exemplary system according to the present invention to practice the method described above and to achieve the enhanced strength pulp according to the invention. In FIG. 5 reference numeral 30 indicates a conventional chip bin in which presteaming takes place, or alternatively the chip bin 30 may be a DIAMONDBACK™ chip bin sold by Andritz Inc. of Glens Falls, N.Y., such as described in U.S. Pat. No. 5,500,083, the disclosure of which is hereby incorporated by reference herein. The bin 30 may be at atmospheric pressure or have a slight overpressure of about 0.1–3 bar, and typically steaming takes place to heat the chips to 80–100 EC for about 10–30 minutes.

The steamed chips from chip bin 30 are then fed—such as utilizing a conventional chip pump 31 (or low or high pressure feeder or the like) via line 32—to the top of a soaking/impregnation vessel 33 according to the present invention. The vessel 33 need not be a pressure vessel—that is the impregnation according to the present invention may take place at atmospheric pressure in the vessel 33.

However it is desired that the pressure in the vessel 33 be a slight overpressure, typically about 1–5 bar, in order to compress gas bubbles and make it easier for the chips to sink. Thus the vessel 33 may be less expensive than conventional impregnation vessels which require about 10–20 bar pressure.

The chip bin 30 and pretreatment vessel 33 may be combined into a single vessel. Atmospheric steaming may be done in the top of the vessel and a liquor level held in the vessel to initiate pretreatment. If necessary to keep the chips submerged in liquor, the vessel may be pressurized.

The soaking/impregnation vessel 33 may have a first zone 34 and a second zone 35, or even more zones. Different liquids may be used during impregnation in these different zones 34, 35, as described in U.S. Pat. No. 5,660,686, the disclosure of which is incorporated by reference herein. The liquor used in the second zone 35 may be hotter and more sulfur-rich than the liquor in zone 34. The temperature in the zone 34 is typically between 80–110° C., preferably 80–100° C., and the material is retained in zone 34 for at least half an hour, typically about 1–4 hours. In the zone 35 the temperature may be raised to about 110–150° C., such as 120–140° C., and the material may be retained in the zone 35 about 10–90 minutes, typically about 10–30 minutes. Alternatively both zones 34, 35 may be at less than 110° C., and the total impregnation time in both zones 34, 35 about 2–4 hours.

FIG. 5 also indicates a conventional screen arrangement—shown generally by reference numeral 36—for removal of some of the liquid surrounding the impregnated chips after the zone 34, which contains a high concentration of dissolved lignin/solids. This liquid may be replaced with replacement liquid added at any desired point in the vessel 33, the replacement liquid having a significantly lower dissolved lignin/solids content than the liquid removed from screens 36 in line 37 so that the dissolved lignin/solids concentration in the pulp once it reaches the continuous digester 40 is about 30–50% less than in conventional continuous digester systems.

The pulp discharged from the bottom of the vessel 33 into line 41 is then transferred—preferably by the conventional high pressure feeder 42 (which both transfers and boosts the pressure of the cellulose 10 slurry)—to the top of the continuous digester 40. Under some circumstances according to the present invention a conventional high pressure feeder 42 may be replaced with a chip pump. In any event the pressure at the top of the digester 40 must be at least about 5 to 10 bar to prevent boiling of the cooking liquor which is at a cooking temperature of about 145–180° C. Since two stage pumping is utilized according to the invention (pumps or stages 31, 42) in the vessel 33 the pressure at the top may be 3–8 bar if a chip pump is used at the stage 42 instead of the high pressure feeder.

The digester 40 preferably is a conventional continuous digester such as sold by Andritz Inc. of Glens Falls, N.Y. such as an MCC® digester, EMOC® digester, or Lo-Solids™ digester. Cooking typically takes place in the zone 44 while washing takes place in zone 45 before the produced, high strength, chemical pulp (preferably kraft pulp) is withdrawn in line 46. (The digester 40 may be completely co-current.) Extraction screens are provided as generally indicated by reference numeral 47. The slurry is heated between vessels 33 and 40 by applying indirect heat transfer in the transfer system between vessel 33 and 40. Heat economy can be improved by using the heat in extraction liquid from screen 47 to preheat the white liquor (or other cooking liquid) before it is added to or before the digester 40.

Figure 6:
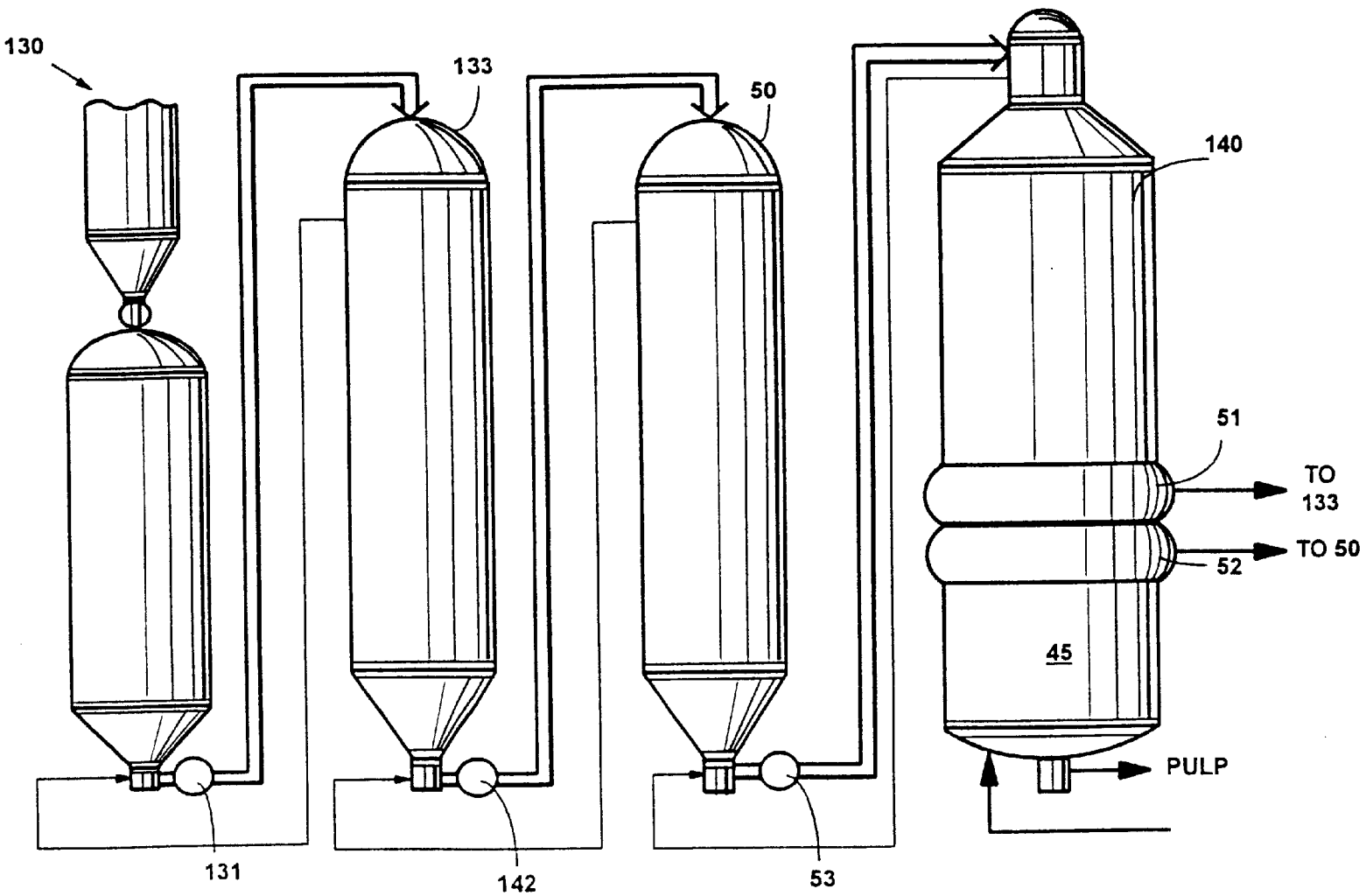
FIG. 6 is a view like that of FIG. 5 only showing an alternative embodiment of equipment that may be utilized.

The system of FIG. 6 is similar to the system of FIG. 5, only is for a pre-existing (i.e. not newly constructed) installation that already has an impregnation vessel. In this embodiment structures comparable to those in the FIG. 5 embodiment are shown by the same reference numeral only preceded by a "1".

In the embodiment of FIG. 6 the pre-existing impregnation vessel for the pulp mill is the vessel 50. The cold impregnation method according to the invention is practiced in the vessel 133 (that is the maximum temperature of about 110 EC) whereas in the vessel 50 an intermediate treatment is provided in which the temperature of the chips is gradually raised, e.g. up to about 110–150 EC, preferably 120–140 EC, so that the cooking conditions can be milder in the digester 140 and even less dissolved wood material will be present during cooking if liquid is removed or displaced in the zones 51, 52, or removed prior to entering digester 150. Another chip pump 53, associated with the vessel 50, is provided, although the chips may also be slurried by means of the liquor in the return line from the top of digester 140. The existing high pressure feeder 142 is provided between the vessels 133, 150.

As an alternative to the systems illustrated in FIGS. 5 and 6, the apparatus such as shown in U.S. Pat. No. 5,476,572 (the disclosure of which is hereby incorporated by reference herein), or that shown in U.S. Pat. No. 5,622,598 (the disclosure of which is also incorporated by reference herein) U.S. Pat. No. 5,476,572 or FIG. 1 of U.S. Pat. No. 5,622,598 may be utilized, with the chips held in the vessels prior to the high pressure feeder or pump for a sufficient time according to the present invention (e.g. 1–4 hours). In this way, and following the teachings of the present invention, it may be possible to eliminate the high pressure feeder normally utilized for continuous kraft systems, especially where an overpressure in the chip bin and a column of slurry is maintained above the pump, and where the digester is completely co-current, or at least does not have a countercurrent wash zone, and/or where the chip bin and soaking vessel are elevated so that they are closer to the top of the digester than ground level.

It will thus be seen that according to the present invention an advantageous method and apparatus are disclosed for producing chemical (particularly kraft) pulp having enhanced strength. This enhanced strength is especially important when using kraft cooking methods. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent methods, pulps, and systems.

What is claimed is:

1. A method of treating wood chips to produce chemical pulp, comprising the steps of sequentially continuously:

(a) steaming the chips to remove air from them and to heat them to a temperature of about 80–100° C.;

(b) soaking the chips in an alkaline liquid having an alkaline concentration of about 0.75 moles per liter or less, at a temperature between about 80–100° C., for a time of 30 minutes to 72 hours to produce dissolved organics;

(c) displacing out at least part of the dissolved organics after step (b) using white liquor, diluted white liquor, bleach plant effluent, or pulp washing effluent; and (d) cooking the material from step (c) to a kappa number below 25.

2. A method as recited in claim 1, wherein the alkaline liquid in step (b) is black liquor, or a mixture of black liquor and white liquor.

3. A method as recited in claim 1, wherein step (c) is practiced so that the amount of dissolved organic solids during cooking in step (d) is 30–50% less as compared to chemical cooking processes in which step (c) is not practiced.

* * * * *